US006225879B1

(12) United States Patent
Schallner et al.

(10) Patent No.: US 6,225,879 B1
(45) Date of Patent: May 1, 2001

(54) UNPERTURBED RING RESONATOR WITH AN ODD OVERTONE VIBRATION MODE

(75) Inventors: Martin Schallner, Ludwigsburg; Willibald Konrath, Weissach, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/178,112

(22) Filed: Oct. 23, 1998

(30) Foreign Application Priority Data

Oct. 25, 1997 (DE) ..... 197 47 253

(51) Int. Cl.[7] ..... H01P 7/08
(52) U.S. Cl. ..... 333/219; 333/235; 333/205
(58) Field of Search ..... 333/204, 205, 333/219, 235

(56) References Cited

U.S. PATENT DOCUMENTS

| | | | | |
|---|---|---|---|---|
| 4,048,589 | * | 9/1977 | Knox et al. | 331/107 R |
| 4,264,881 | * | 4/1981 | De Ronde | 333/204 X |
| 5,406,238 | * | 4/1995 | Suzuki | 333/219 |
| 5,587,690 | * | 12/1996 | Yabuki et al. | 331/49 X |
| 5,659,274 | * | 8/1997 | Takahashi et al. | 333/204 |

FOREIGN PATENT DOCUMENTS

| | | | |
|---|---|---|---|
| 0911905 A1 | * | 4/1999 | (EP) . |
| 2 631 757 | | 11/1989 | (FR) . |
| 55-138902 | * | 10/1980 | (JP) . |
| 62-110301 | * | 5/1987 | (JP) . |

OTHER PUBLICATIONS

J.M. Carroll and K. Chang; "Microstrip Mode Suppression Ring Resonator"; *Electronic Letters* vol. 30, No. 22, Oct. 27, 1994, pp. 1861–1862.*

G.K. Gopalakrishnan & K. Chang; "Novel Excitation Schemes for the Microstrip Ring Resonator with Lower Insertion Loss"; *Electronics Letters,* 20$^{th}$ Jan. 1994, vol. 30, No. 2, pp. 148–149.*

Faton Tefiku & Eikichi Yamashita; "An Efficient Method for the Determination of Resonant Frequencies of Shielded Circular Disk and Ring Resonators"; *IEEE Transactions on Microwave Theory and Techniques,* vol. 41, No. 2, Feb., 1993, pp. 343–346.*

Ji–Yong Park and Jong–Chul Lee; "A New Coupling Structure of Microstrip Ring Resonator With Two Coupled Lines and a Slit"; *IEEE MTT–5 Digest 1998,* vol. 2, Conference date Jun. 7–12, 1998, pp. 805–808.*

U. Karacaoglu et al.; "Harmonic Suppression In Microstrip Dual–Mode Ring–Resonator Bandpass Filters"; *IEEE MTT–5 Digest 1996,* pp. 1635–1638, Conference date Jun. 17–21, 1996.*

"Varactor Tuned Ring Resonator Mocrowave Oscillator", by Shin–Lin Lu and A.M. Ferendeci, *Electronics Letters,* vol. 32, No. 1, Jan. 4, 1996, pp. 46–48.

"Vergleich Und Gueetigkeit Verschiedener Berechnungsverfahren Der Resonanzfrequenzen Von Mikrostrip–Ringresonatoren", by Norbert Knoppik, Nachrichtentechn, Z. 29 (1976) H.2, pp. 141–147.

J.J. Jimenez et al: Experimental Q Factors of Three of Mictostrip Resonators, In Revue de Physique Appliquee, vol. 8, pp. 279–282, Sep. 1973.

* cited by examiner

*Primary Examiner*—Robert Pascal
*Assistant Examiner*—Barbara Summons
(74) *Attorney, Agent, or Firm*—Michael J. Striker

(57) ABSTRACT

The ring resonator of a high Q-factor has a planar conducting ring (1) that is dimensioned in regard to its conductor width (w) and its diameter (d) so that it resonates in an odd harmonic or overtone vibration mode but not in its fundamental mode.

3 Claims, 1 Drawing Sheet

UNPERTURBED RING RESONATOR WITH AN ODD OVERTONE VIBRATION MODE

BACKGROUND OF THE INVENTION

1. Field of the Invention

The present invention relates to a ring resonator comprising a planar conducting ring arranged on a substrate beside a planar conductor of a microwave circuit. This type of ring resonator is also used in a microwave circuit in order to, e.g., tune an oscillator to a desired resonance frequency or in order to filter out a predetermined small frequency band from a larger frequency range.

2. Prior Art

A ring resonator whose conducting ring is dimensioned in regard to its width and its diameter so that it is driven at its fundamental frequency is described in the article, "Varactor Tuned Ring Resonator Microwave Oscillator", Electronics Letters, Vol. 32, No. 1, 1996, pp. 46 to 48, by Shih-Lin Lu and A. M. Ferendeci. Two closely neighboring modes occur at this fundamental frequency, one of which must be suppressed. That happens by means of a slot provided in the conducting ring. The ring resonator has a higher radiation of electromagnetic radiation because of this slot and thus the Q-factor of the resonator is disadvantageously reduced. The resonance frequency depends strongly on the spacing of the ring resonator from the cover of the housing in which the microwave circuit with the ring resonator is mounted because of the high radiation from the resonator. The resonance frequency is subjected to undesirable changes because of variations of the spacing of the housing cover from the ring resonator—originating from the thermal expansion of the housing or from mechanical vibrations.

SUMMARY OF THE INVENTION

It is an object of the present invention to provide a ring resonator of the above-described type that has as high a resonator Q-factor as possible and which can be provided with a minimum expense.

These objects, and others that will be made more apparent hereinafter, are attained in a ring resonator comprising a planar conducting ring arranged on a substrate beside a planar conductor of a microwave circuit.

According to the invention the conducting ring has a conductor width and diameter dimensioned so that it resonates with an odd overtone vibration mode.

Because the ring resonator is not operated in its fundamental mode but instead in an odd overtone mode, its diameter is greater than in fundamental mode operation. That means that the curvature of the conducting ring is less so that the radiation of electromagnetic energy is substantially reduced so that the resonance Q-factor is clearly increased. In overtone operation then many modes no longer occur next to each other so that the slot in the conducting ring for suppression of modes can be dispensed with and because of that a further increase in the Q-factor can be obtained. The spacing between the ring resonator and the housing cover less strongly effects the resonance frequency because of the reduced radiation of the electromagnetic energy. The larger size of the conducting ring also has the advantage that it is insensitive to manufacturing tolerances.

According to a preferred embodiment of the invention a coupler can be arranged beside the conducting ring for tuning the resonance frequency. A Varactor diode can be connected to it for the purpose of variable tuning of the resonance frequency.

BRIEF DESCRIPTION OF THE DRAWINGS

The objects, features and advantages of the present invention will be explained in more detail by the following examples with reference to the drawings, in which.

DESCRIPTION OF THE PREFERRED EMBODIMENT

Figure 1:
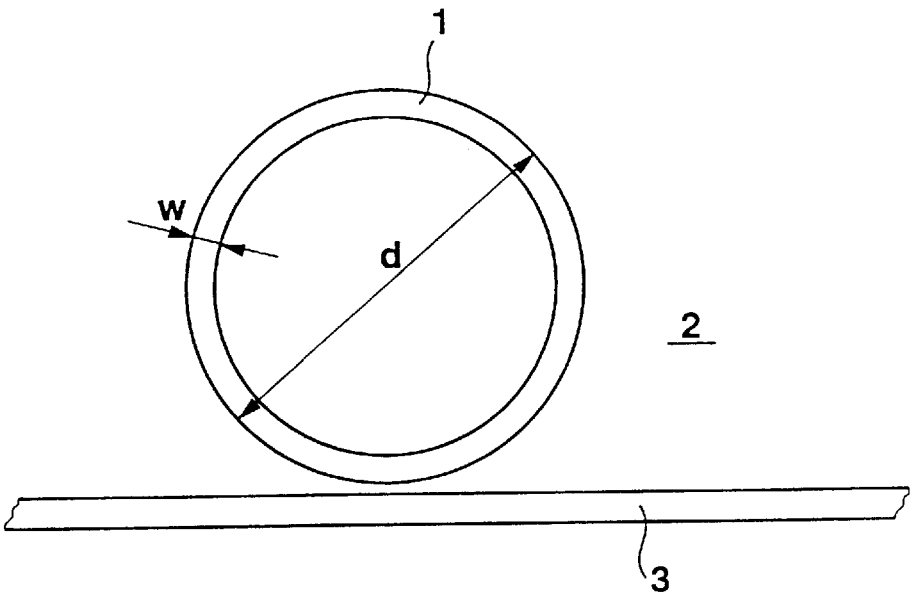
FIG. 1 is a plan view of one embodiment of a planar ring resonator according to the invention.
Figure 2:
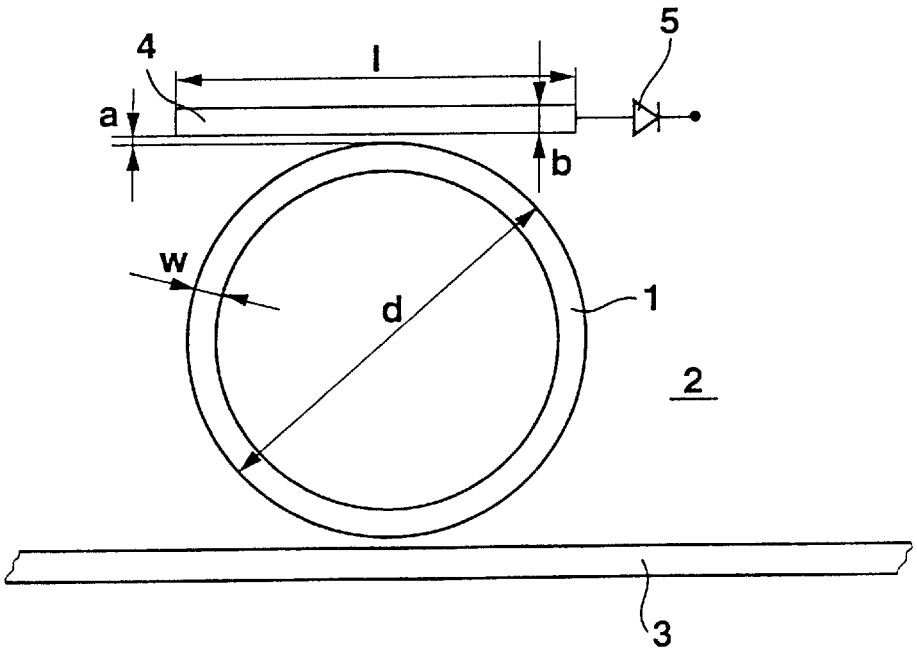
FIG. 2 is a plan view of another embodiment of a planar ring resonator with a coupler.

A ring resonator is shown in FIGS. 1 and 2, which comprises a planar conducting ring 1, which is mounted on a substrate 2 in the plane of the drawing. The conducting ring 1 is arranged beside a planar conductor 3, which is part of a microwave circuit. The degree of coupling between the ring resonator and the conductor 3 depends on the spacing between the conducting ring 1 and the planar conductor 3. The width w and the outer diameter d of the conducting ring 1 are dimensioned so that the ring resonator resonates with a first, third, fifth, and so on, overtone mode. The first overtone mode occurs at about 18.5 Ghz with an outer diameter d of 4.4 mm and a conductor width of 0.34 mm for the conducting ring 1, when, e.g., an $Al_2O_3$ ceramic substrate having a thickness of 0.381 mm is used.

The ring resonator can be mounted on different substrate materials with reduced losses. However a substrate with a comparatively high dielectric constant (e.g. $Al_2O_3$) is especially suitable, because the field is very strongly concentrated in this substrate and thus the environment has an only reduced influence on the resonance frequency. A reduced temperature dependence of the dielectric constant of selected substrate causes the resonance frequency to change only slightly. A reduction of the temperature dependence of the resonance frequency can be achieved especially when the temperature coefficient of the dielectric constant is adjusted in the manufacture of the substrate so that the influence of the different temperature-dependent mechanisms (e.g. linear expansion) can be compensated.

A coupler 4 is also arranged beside the conducting ring 1 in the embodiment shown in FIG. 2. A predetermined resonance frequency can be set with this coupler 4 according to its length l and width b. The coupling between the coupler 4 and the ring resonator 1 is determined by its spacing a. When the resonance frequency should be tunable electrically, it is appropriate to connect a Varactor diode 5 to the coupler 4, to which a control voltage can be applied.

The present invention is also described in German Patent Application 197 47 253.2 of Oct. 25, 1997, which is incorporated here by reference and forms the basis for a claim of priority under 35 U.S.C. 119 for the appended claims.

While the invention has been illustrated and described as embodied in a ring resonator, it is not intended to be limited to the details shown, since various modifications and structural changes may be made without departing from the spirit of the present invention.

Without further analysis, the foregoing will so fully reveal the gist of the invention that others can, by applying current knowledge, readily adapt it for various applications without omitting features that, from the standpoint of the prior art, fairly constitute essential characteristics of the generic and specific aspects of the present invention.

What is claimed is new and desired to be protected by Letters Patent is set forth in the appended claims:

1. A ring resonator comprising a planar conducting ring (1) arranged on a substrate (2) and a planar conductor (3) of a microwave circuit arranged on the substrate (2) beside the planar conducting ring (1), wherein the conducting ring is unperturbed and has a conductor width (w) and diameter (d) dimensioned so that the ring resonator resonates with an odd overtone vibration mode but not in a fundamental mode thereof.

2. The ring resonator as defined in claim 1, further comprising a planar coupler (4) arranged on the substrate beside the conducting ring (1), wherein the planar coupler (4) has a spacing from the conducting ring (1) and a length (l) and a width (b) such that a predetermined resonance frequency is obtained.

3. The ring resonator as defined in claim 2, further comprising a varactor diode (5) connected to the coupler (4).

* * * * *